US007926561B2

(12) United States Patent
Berg

(10) Patent No.: US 7,926,561 B2
(45) **Date of Patent: *Apr. 19, 2011**

(54) SYSTEMS AND METHODS FOR PRODUCING OIL AND/OR GAS

(75) Inventor: Steffen Berg, Rijswijk (NL)

(73) Assignee: Shell Oil Company, Houston, TX (US)

( * ) Notice: Subject to any disclaimer, the term of this patent is extended or adjusted under 35 U.S.C. 154(b) by 80 days.

This patent is subject to a terminal disclaimer.

(21) Appl. No.: 12/262,010

(22) Filed: Oct. 30, 2008

(65) Prior Publication Data

US 2009/0188669 A1 Jul. 30, 2009

Related U.S. Application Data

(60) Provisional application No. 60/984,004, filed on Oct. 31, 2007.

(51) Int. Cl.
*E21B 43/22* (2006.01)
*E21B 43/24* (2006.01)
*E21B 43/30* (2006.01)
*E21B 43/40* (2006.01)

(52) U.S. Cl. ..... 166/245; 166/52; 166/75.12; 166/266; 166/268; 166/270.1; 166/272.1; 166/275; 166/400; 166/401; 166/402

(58) Field of Classification Search ..... 166/245, 166/272.1
See application file for complete search history.

(56) References Cited

U.S. PATENT DOCUMENTS

| | | | | |
|---|---|---|---|---|
| 2,330,934 A | | 10/1943 | Thacker | 23/206 |
| 2,492,719 A | | 12/1949 | Thacker | 23/206 |
| 2,636,810 A | | 4/1953 | Marisic | 23/206 |
| 2,670,801 A | | 3/1954 | Sherborne | |
| 3,084,743 A | * | 4/1963 | West et al. | 166/402 |
| 3,087,788 A | | 4/1963 | Porter | 23/181 |
| 3,345,135 A | | 10/1967 | Kerr et al. | 23/206 |
| 3,366,452 A | | 1/1968 | Lauer | 23/204 |
| 3,387,888 A | * | 6/1968 | Shock et al. | 299/4 |
| 3,393,733 A | | 7/1968 | Kuo et al. | |

(Continued)

FOREIGN PATENT DOCUMENTS

EP 581026 2/1994

(Continued)

OTHER PUBLICATIONS

Wellington, et al.: Low Surfactant Concentration Enhanced Waterflooding, Society of Petroleum Engineers, SPE Annual Technical Conference & Exhibition, Dallas, Oct. 22-25, 1995, published SPE 30748, SPE Jrnl, vol. 2, Dec. 1997.

*Primary Examiner* — George Suchfield
(74) *Attorney, Agent, or Firm* — William E. Hickman

(57) ABSTRACT

A system for producing oil and/or gas from an underground formation comprising a first array of wells dispersed above the formation; a second array of wells dispersed above the formation; wherein the first array of wells comprises a mechanism to inject a miscible enhanced oil recovery formulation into the formation while the second array of wells comprises a mechanism to produce oil and/or gas from the formation for a first time period; and wherein the second array of wells comprises a mechanism to inject a remediation agent into the formation while the first array of wells comprises a mechanism to produce the miscible enhanced oil recovery formulation from the formation for a second time period.

27 Claims, 7 Drawing Sheets

U.S. PATENT DOCUMENTS 3,402,768 A 9/1968 Felsenthal et al.
3,415,573 A * 12/1968 Fraser ..... 299/4
3,429,372 A * 2/1969 Connally, Jr ..... 166/245
3,498,378 A 3/1970 Stone et al. ..... 166/263
3,512,585 A * 5/1970 Allen ..... 166/245
3,581,821 A 6/1971 Ross ..... 166/245
3,647,906 A 3/1972 Farley ..... 260/683 D
3,672,448 A 6/1972 Hoyt ..... 166/245
3,724,553 A 4/1973 Snavely, Jr. et al. ..... 166/304
3,729,053 A 4/1973 Froning ..... 166/304
3,754,598 A 8/1973 Holloway, Jr. ..... 166/249
3,794,114 A 2/1974 Brandon ..... 166/249
3,805,892 A 4/1974 Haynes, Jr. ..... 166/245
3,822,748 A 7/1974 Allen et al. ..... 166/269
3,823,777 A 7/1974 Allen et al. ..... 166/266
3,838,738 A * 10/1974 Redford et al. ..... 166/271
3,840,073 A 10/1974 Allen et al. ..... 166/274
3,847,221 A 11/1974 Allen et al. ..... 166/274
3,847,224 A * 11/1974 Allen et al. ..... 166/268
3,850,245 A 11/1974 Allen et al. ..... 166/274
3,878,892 A 4/1975 Allen et al. ..... 166/267
3,908,762 A * 9/1975 Redford ..... 166/402
3,913,672 A * 10/1975 Allen et al. ..... 166/402
3,927,185 A 12/1975 Meadow et al. ..... 423/443
3,943,160 A 3/1976 Farmer, III et al. ..... 260/458
3,946,812 A 3/1976 Gale et al. ..... 166/274
4,008,764 A 2/1977 Allen ..... 166/266
4,057,613 A 11/1977 Meadow et al. ..... 423/443
4,077,471 A 3/1978 Shupe et al. ..... 166/275
4,122,156 A 10/1978 Kittrell et al. ..... 423/443
4,182,416 A 1/1980 Trantham et al. ..... 166/245
4,216,079 A 8/1980 Newcombe ..... 208/188
4,305,463 A 12/1981 Zakiewicz ..... 106/245
4,330,038 A 5/1982 Soukup et al. ..... 166/267
4,393,937 A 7/1983 Dilgren et al. ..... 166/272
4,427,067 A * 1/1984 Stone ..... 166/272.2
4,476,113 A 10/1984 Young et al. ..... 424/161
4,488,976 A 12/1984 Dilgren et al.
4,512,400 A * 4/1985 Simon ..... 166/245
4,543,434 A 9/1985 Chang ..... 585/310
4,550,779 A 11/1985 Zakiewicz ..... 166/248
4,727,937 A 3/1988 Shum et al. ..... 166/245
4,744,417 A * 5/1988 Alameddine ..... 166/245
4,822,938 A 4/1989 Audeh et al. ..... 585/324
4,836,935 A * 6/1989 Lilienthal ..... 210/788
4,963,340 A 10/1990 Audeh et al. ..... 423/444
5,014,784 A 5/1991 Shen ..... 166/263
5,062,970 A 11/1991 Muijs et al.
5,065,821 A 11/1991 Huang et al. ..... 166/245
5,076,358 A 12/1991 Kissel ..... 166/275
5,089,246 A * 2/1992 Schatz ..... 423/563
5,097,903 A * 3/1992 Wilensky ..... 166/266
5,120,935 A 6/1992 Nenniger ..... 392/305
5,167,280 A 12/1992 Sanchez et al. ..... 166/267
5,318,709 A 6/1994 Wuest et al.
5,607,016 A 3/1997 Butler ..... 166/263
5,609,845 A 3/1997 Cimini et al. ..... 423/648.1
5,723,423 A 3/1998 Van Slyke ..... 510/188
5,803,171 A 9/1998 McCaffery et al. ..... 166/245
5,826,656 A 10/1998 McGuire et al. ..... 166/305.1
6,022,834 A 2/2000 Hsu et al. ..... 507/259
6,136,282 A 10/2000 Fisher ..... 423/220
6,149,344 A 11/2000 Eaton ..... 405/128
6,241,019 B1 6/2001 Davidson et al. ..... 166/249
6,269,881 B1 8/2001 Chou et al. ..... 166/270.1
6,405,797 B2 6/2002 Davidson et al. ..... 166/249
6,497,855 B1 12/2002 Wachs ..... 423/648.1
6,506,349 B1 1/2003 Khanmamedov ..... 423/210
6,706,108 B2 3/2004 Polston ..... 106/285
6,851,473 B2 2/2005 Davidson ..... 166/263
6,893,620 B2 5/2005 Watson et al. ..... 423/224
6,919,059 B2 7/2005 Watson et al. ..... 423/224
6,919,296 B2 7/2005 Geus et al. ..... 502/325
6,946,111 B2 9/2005 Keller et al. ..... 423/576.2
7,025,134 B2 4/2006 Byrd et al. ..... 166/105
7,090,818 B2 8/2006 Stauffer ..... 423/443
7,128,150 B2 10/2006 Thomas et al. ..... 166/266
7,426,959 B2 9/2008 Wang et al. ..... 166/52
7,654,322 B2 * 2/2010 Wang et al. ..... 166/266
2003/0194366 A1 10/2003 Srinivas et al. ..... 423/230
2004/0159583 A1 8/2004 Mesters et al. ..... 208/208
2005/0189108 A1 9/2005 Davidson ..... 166/249
2006/0254769 A1 11/2006 Wang et al. ..... 166/266
2007/0251686 A1 11/2007 Sivrikoz et al. ..... 166/249
2008/0023198 A1 1/2008 Hsu ..... 166/268
2008/0087425 A1 4/2008 Hsu et al. ..... 166/266

FOREIGN PATENT DOCUMENTS

GB 1007674 10/1965
GB 1173344 12/1969
GB 2379685 3/2003
WO WO9850679 11/1998
WO WO2007131976 11/2007
WO WO2007131977 11/2007
WO WO2008003732 1/2008
WO WO2008034777 3/2008

* cited by examiner

SYSTEMS AND METHODS FOR PRODUCING OIL AND/OR GAS

This application claims the benefit of U.S. Provisional Application No. 60/984,004 filed Oct. 31, 2007, the entire disclosure of which is hereby incorporated by reference.

FIELD OF THE INVENTION

The present disclosure relates to systems and methods for producing oil and/or gas.

BACKGROUND OF THE INVENTION

Enhanced Oil Recovery (EOR) may be used to increase oil recovery in fields worldwide. There are three main types of EOR, thermal, chemical/polymer and gas injection, which may be used to increase oil recovery from a reservoir, beyond what can be achieved by conventional means—possibly extending the life of a field and boosting the oil recovery factor.

Thermal enhanced recovery works by adding heat to the reservoir. The most widely practiced form is a steamdrive, which reduces oil viscosity so that it can flow to the producing wells. Chemical flooding increases recovery by reducing the capillary forces that trap residual oil. Polymer flooding improves the sweep efficiency of injected water. Miscible injection works in a similar way to chemical flooding. By injecting a fluid that is miscible with the oil, trapped residual oil can be recovered.

Referring to FIG. 1, there is illustrated prior art system 100. System 100 includes underground formation 102, underground formation 104, underground formation 106, and underground formation 108. Production facility 110 is provided at the surface. Well 112 traverses formations 102 and 104, and terminates in formation 106. The portion of formation 106 is shown at 114. Oil and gas are produced from formation 106 through well 112, to production facility 110. Gas and liquid are separated from each other, gas is stored in gas storage 116 and liquid is stored in liquid storage 118.

U.S. Pat. No. 5,826,656 discloses a method for recovering waterflood residual oil from a waterflooded oil-bearing subterranean formation penetrated from an earth surface by at least one well by injecting an oil miscible solvent into a waterflood residual oil-bearing lower portion of the oil-bearing subterranean formation through a well completed for injection of the oil miscible solvent into the lower portion of the oil-bearing formation; continuing the injection of the oil miscible solvent into the lower portion of the oil-bearing formation for a period of time equal to at least one week; recompleting the well for production of quantities of the oil miscible solvent and quantities of waterflood residual oil from an upper portion of the oil-bearing formation; and producing quantities of the oil miscible solvent and waterflood residual oil from the upper portion of the oil-bearing formation. The formation may have previously been both waterflooded and oil miscible solvent flooded. The solvent may be injected through a horizontal well and solvent and oil may be recovered through a plurality of wells completed to produce oil and solvent from the upper portion of the oil-bearing formation. U.S. Pat. No. 5,826,656 is herein incorporated by reference in its entirety.

Co-pending U.S. patent application Ser. No. 11/409,436, having Publication Number 2006/0254769, published Nov. 16, 2006, issued as U.S. Pat. No. 7,426,959, discloses a system including a mechanism for recovering oil and/or gas from an underground formation, the oil and/or gas comprising one or more sulfur compounds; a mechanism for converting at least a portion of the sulfur compounds from the recovered oil and/or gas into a carbon disulfide formulation; and a mechanism for releasing at least a portion of the carbon disulfide formulation into a formation. U.S. Patent Application Publication Number 2006/0254769 is herein incorporated by reference in its entirety.

U.S. Pat. No. 5,062,970 discloses a surfactant composition, suitable for enhanced oil recovery comprising in a 60:40 to 10/90 weight ratio a) (o,m)- and/or (o,p)-dialkylbenzene alkali sulfonate and b) polyalkoxyphenyl ether alkali sulfonate. U.S. Pat. No. 5,062,970 is herein incorporated by reference in its entirety.

Other compositions and methods for enhanced hydrocarbons recovery are described in U.S. Pat. No. 3,943,160; U.S. Pat. No. 3,946,812; U.S. Pat. No. 4,077,471; U.S. Pat. No. 4,216,079; U.S. Pat. No. 5,318,709; U.S. Pat. No. 5,723,423; U.S. Pat. No. 6,022,834; U.S. Pat. No. 6,269,881; and by Wellington, et al. in "Low Surfactant Concentration Enhanced Waterflooding," Society of Petroleum Engineers, 1995; all of which are incorporated by reference herein.

There is a need in the art for improved systems and methods for enhanced oil recovery. There is a further need in the art for improved systems and methods for enhanced oil recovery using a solvent, for example through viscosity reduction, chemical effects, and miscible flooding. There is a further need in the art for improved systems and methods for solvent miscible flooding. There is a further need in the art for improved systems and methods for recovering a solvent after miscible flooding.

SUMMARY OF THE INVENTION

In one aspect, the invention provides a system for producing oil and/or gas from an underground formation comprising a first array of wells dispersed above the formation; a second array of wells dispersed above the formation; wherein the first array of wells comprises a mechanism to inject a miscible enhanced oil recovery formulation into the formation while the second array of wells comprises a mechanism to produce oil and/or gas from the formation for a first time period; and wherein the second array of wells comprises a mechanism to inject a remediation agent into the formation while the first array of wells comprises a mechanism to produce the miscible enhanced oil recovery formulation from the formation for a second time period.

In another aspect, the invention provides a method for producing oil and/or gas comprising injecting a carbon disulfide formulation into a formation for a first time period from a first well; producing oil and/or gas from the formation from a second well for the first time period; injecting a remediation agent into the formation for a second time period from the second well; and producing the carbon disulfide formulation from the formation from the first well for the second time period.

Advantages of the invention include one or more of the following:

Improved systems and methods for enhanced recovery of hydrocarbons from a formation with a solvent.

Improved systems and methods for enhanced recovery of hydrocarbons from a formation with a fluid containing a miscible solvent.

Improved compositions and/or techniques for secondary recovery of hydrocarbons.

Improved systems and methods for enhanced oil recovery.

Improved systems and methods for enhanced oil recovery using a miscible solvent.

Improved systems and methods for enhanced oil recovery using a compound which may be miscible with oil in place.

Improved systems and methods for recovering a compound which may be miscible with oil in place.

DETAILED DESCRIPTION OF THE INVENTION

FIG. 2*a:*

Figure 1:
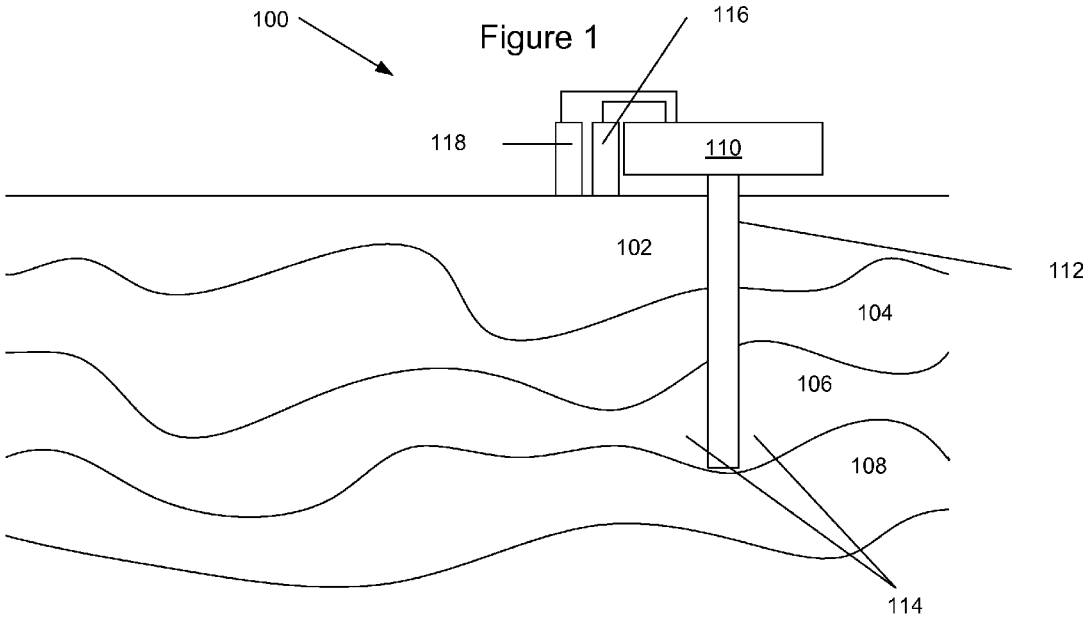
Figure 1 Prior Art
FIG. 1 illustrates an oil and/or gas production system.
Figure 2A:
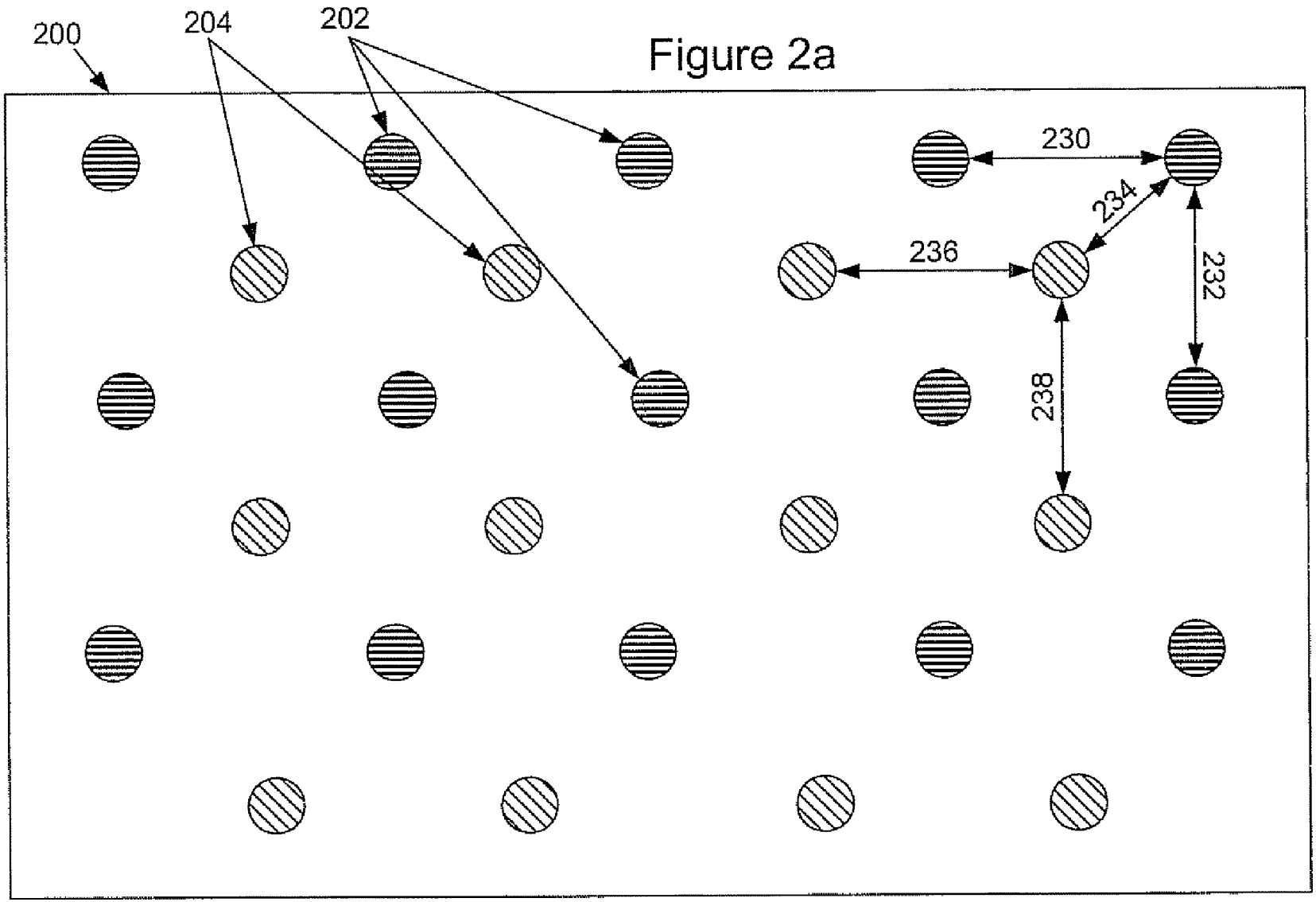
FIG. 2*a* illustrates a well pattern.

Referring now to FIG. 2*a*, in some embodiments, an array of wells 200 is illustrated. Array 200 includes well group 202 (denoted by horizontal lines) and well group 204 (denoted by diagonal lines).

Each well in well group 202 has horizontal distance 230 from the adjacent well in well group 202. Each well in well group 202 has vertical distance 232 from the adjacent well in well group 202.

Each well in well group 204 has horizontal distance 236 from the adjacent well in well group 204. Each well in well group 204 has vertical distance 238 from the adjacent well in well group 204.

Each well in well group 202 is distance 234 from the adjacent wells in well group 204. Each well in well group 204 is distance 234 from the adjacent wells in well group 202.

Each well in well group 202 may be surrounded by four wells in well group 204. Each well in well group 204 may be surrounded by four wells in well group 202.

Horizontal distance 230 is from about 5 to about 1000 meters, or from about 10 to about 500 meters, or from about 20 to about 250 meters, or from about 30 to about 200 meters, or from about 50 to about 150 meters, or from about 90 to about 120 meters, or about 100 meters.

Vertical distance 232 may be from about 5 to about 1000 meters, or from about 10 to about 500 meters, or from about 20 to about 250 meters, or from about 30 to about 200 meters, or from about 50 to about 150 meters, or from about 90 to about 120 meters, or about 100 meters.

Horizontal distance 236 may be from about 5 to about 1000 meters, or from about 10 to about 500 meters, or from about 20 to about 250 meters, or from about 30 to about 200 meters, or from about 50 to about 150 meters, or from about 90 to about 120 meters, or about 100 meters.

Vertical distance 238 may be from about 5 to about 1000 meters, or from about 10 to about 500 meters, or from about 20 to about 250 meters, or from about 30 to about 200 meters, or from about 50 to about 150 meters, or from about 90 to about 120 meters, or about 100 meters.

Distance 234 may be from about 5 to about 1000 meters, or from about 10 to about 500 meters, or from about 20 to about 250 meters, or from about 30 to about 200 meters, or from about 50 to about 150 meters, or from about 90 to about 120 meters, or about 100 meters.

Array of wells 200 may have from about 10 to about 1000 wells, for example from about 5 to about 500 wells in well group 202, and from about 5 to about 500 wells in well group 204.

Array of wells 200 may be seen as a top view with well group 202 and well group 204 being vertical wells spaced on a piece of land. Array of wells 200 may be seen as a cross-sectional side view with well group 202 and well group 204 being horizontal wells spaced within a formation.

The recovery of oil and/or gas with array of wells 200 from an underground formation may be accomplished by any known method. Suitable methods include subsea production, surface production, primary, secondary, or tertiary production. The selection of the method used to recover the oil and/or gas from the underground formation is not critical.

FIG. 2*b:*

Figure 2B:
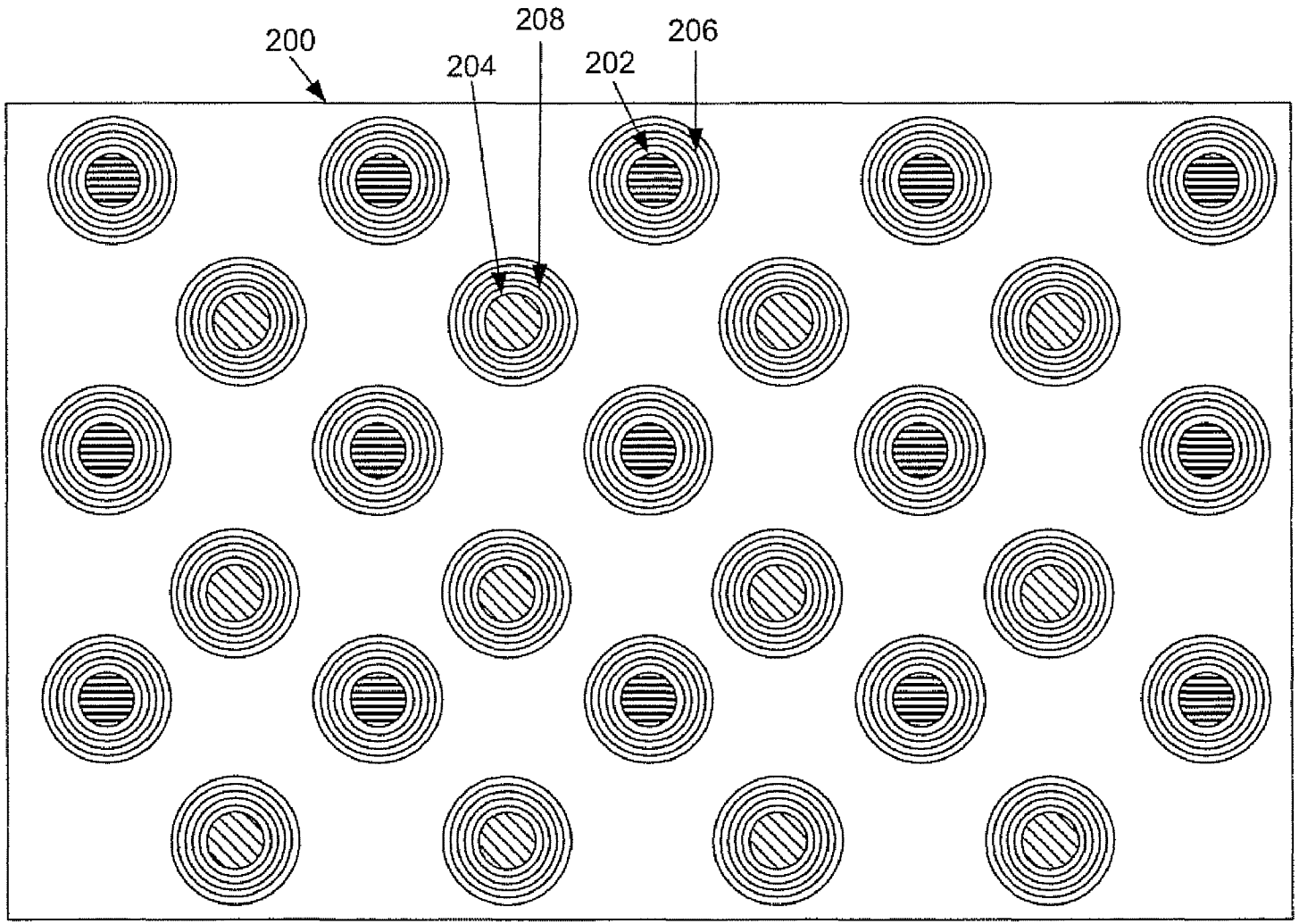
FIGS. 2*b* and 2*c* illustrate the well pattern of FIG. 2*a* during enhanced oil recovery processes.

Referring now to FIG. 2*b*, in some embodiments, array of wells 200 is illustrated. Array 200 includes well group 202 (denoted by horizontal lines) and well group 204 (denoted by diagonal lines).

In some embodiments, a miscible enhanced oil recovery agent may be injected into well group 204, and oil may be recovered from well group 202. As illustrated, the miscible enhanced oil recovery agent has injection profile 208, and oil recovery profile 206 is being produced to well group 202.

A miscible enhanced oil recovery agent may be injected into well group 202, and oil may be recovered from well group 204. As illustrated, the miscible enhanced oil recovery agent has injection profile 206, and oil recovery profile 208 is being produced to well group 204.

Well group 202 may be used for injecting a miscible enhanced oil recovery agent, and well group 204 may be used for producing oil and/or gas from the formation for a first time period; then well group 204 may be used for injecting a miscible enhanced oil recovery agent, and well group 202 may be used for producing oil and/or gas from the formation for a second time period, where the first and second time periods comprise a cycle.

Multiple cycles may be conducted which include alternating well groups 202 and 204 between injecting a miscible enhanced oil recovery agent, and producing oil and/or gas from the formation, where one well group may be injecting and the other may be producing for a first time period, and then they are switched for a second time period.

A cycle may be from about 12 hours to about 1 year, or from about 3 days to about 6 months, or from about 5 days to about 3 months. Each cycle may increase in time, for example each cycle may be from about 5% to about 10% longer than the previous cycle, for example about 8% longer.

A miscible enhanced oil recovery agent or a mixture including a miscible enhanced oil recovery agent may be injected at the beginning of a cycle, and an immiscible enhanced oil recovery agent or a mixture including an immiscible enhanced oil recovery agent may be injected at the end of the cycle. The beginning of a cycle may be the first 10% to about 80% of a cycle, or the first 20% to about 60% of a cycle, the first 25% to about 40% of a cycle, and the end may be the remainder of the cycle.

FIG. 2*c:*

Figure 2C:
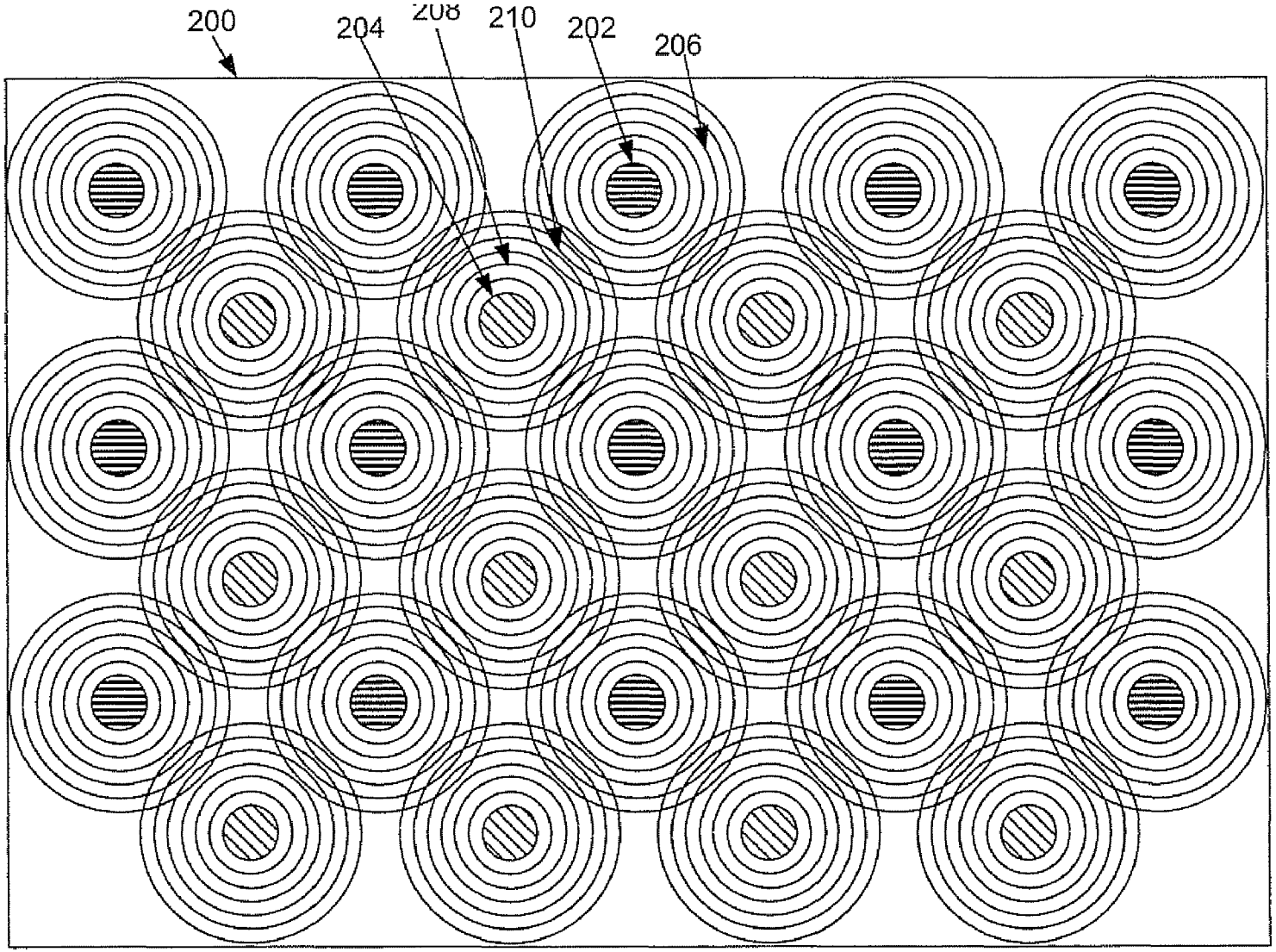

Referring now to FIG. 2*c*, in some embodiments, array of wells 200 is illustrated. Array 200 includes well group 202 (denoted by horizontal lines) and well group 204 (denoted by diagonal lines).

A miscible enhanced oil recovery agent may be injected into well group 204, and oil may be recovered from well group 202. As illustrated, the miscible enhanced oil recovery agent has injection profile 208 with overlap 210 with oil recovery profile 206, which is being produced to well group 202.

A miscible enhanced oil recovery agent may be injected into well group 202, and oil may be recovered from well group 204. As illustrated, the miscible enhanced oil recovery agent has injection profile 206 with overlap 210 with oil recovery profile 208, which is being produced to well group 204.

In order to recover miscible enhanced oil recovery agent from injection profile 206 back to well group 202, a remediation agent may be injected into well group 204, after the oil recovery from well group 204 has been completed. Suitable remediation agents are discussed below.

Figure 3A:
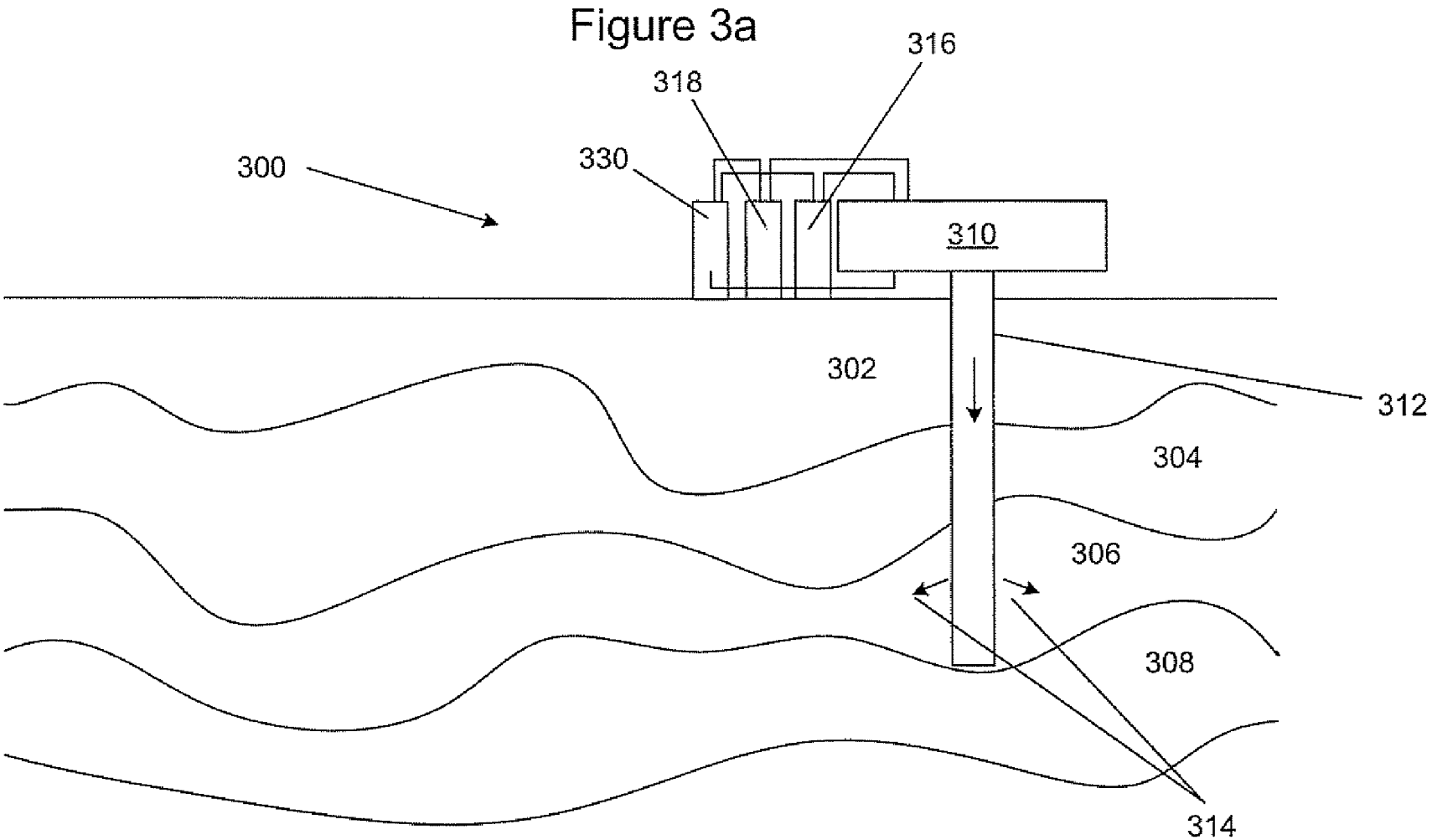
FIGS. 3*a*-3*c* illustrate oil and/or gas production systems.
Figure 3B:
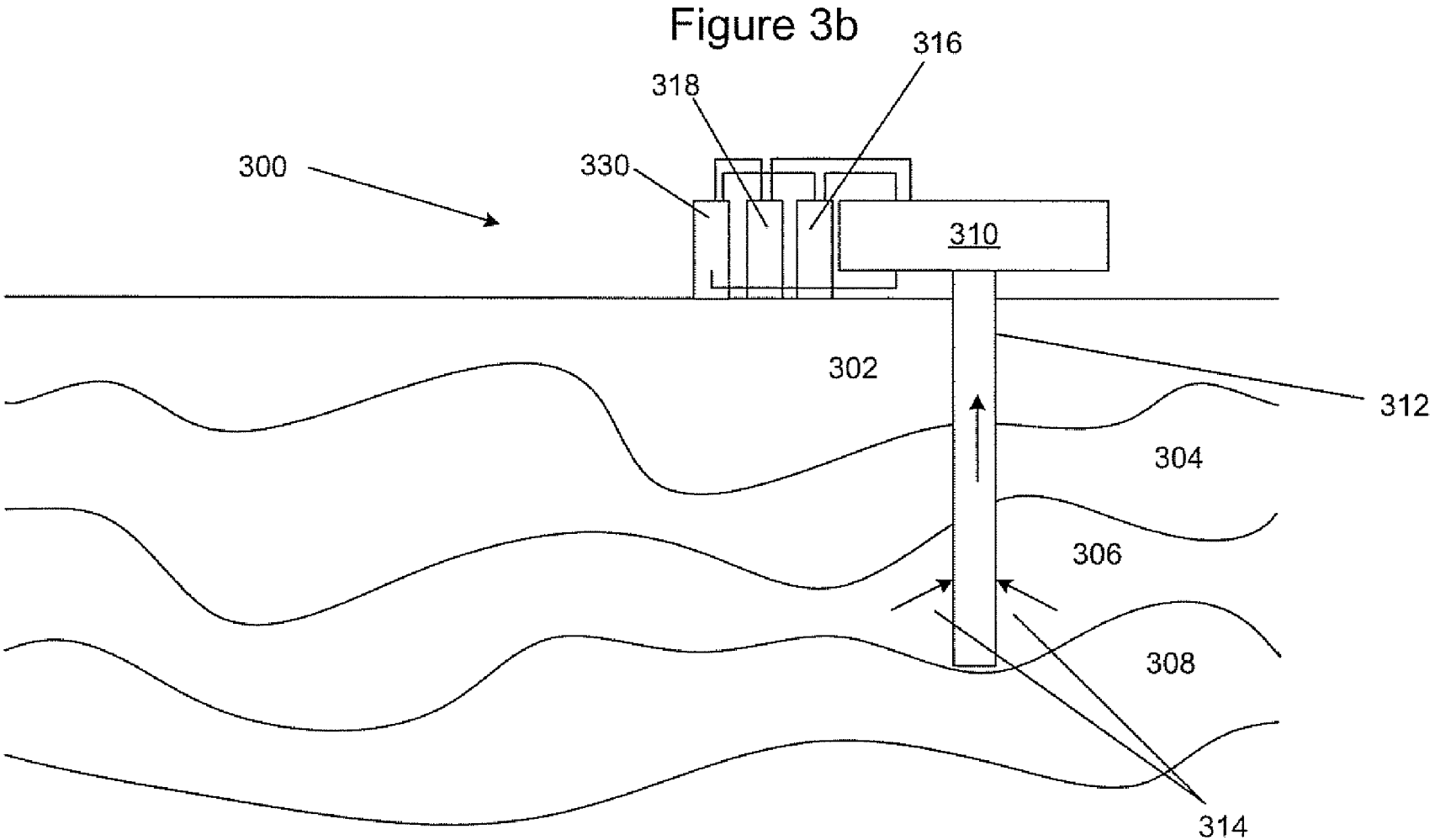

FIGS. 3*a* and 3*b:*

Referring now to FIGS. 3*a* and 3*b*, in some embodiments of the invention, system 300 is illustrated. System 300 includes underground formation 302, underground formation 304, underground formation 306, and underground formation 308. Facility 310 may be provided at the surface. Well 312 traverses formations 302 and 304, and has openings in formation 306. Portions 314 of formation 306 may be optionally fractured and/or perforated. During primary production, oil and gas from formation 306 may be produced into portions 314, into well 312, and travels up to facility 310. Facility 310 then separates gas, which may be sent to gas processing 316, and liquid, which may be sent to liquid storage 318. Facility 310 also includes miscible enhanced oil recovery formulation storage 330. As shown in FIG. 3*a*, miscible enhanced oil recovery formulation may be pumped down well 312 that is shown by the down arrow and pumped into formation 306. Miscible enhanced oil recovery formulation may be left to soak in formation for a period of time from about 1 hour to about 15 days, for example from about 5 to about 50 hours.

After the soaking period, as shown in FIG. 3*b*, miscible enhanced oil recovery formulation and oil and/or gas may be then produced back up well 312 to facility 310. Facility 310 may be adapted to separate and/or recycle miscible enhanced oil recovery formulation, for example by boiling the formulation, condensing it or filtering or reacting it, then re-injecting the formulation into well 312, for example by repeating the soaking cycle shown in FIGS. 3*a* and 3*b* from about 2 to about 5 times.

In some embodiments, miscible enhanced oil recovery formulation may be pumped into formation 306 below the fracture pressure of the formation, for example from about 40% to about 90% of the fracture pressure.

Well 312, as shown in FIG. 3*a*, injecting into formation 306 may be representative of a well in well group 202, and well 312 as shown in FIG. 3*b* producing from formation 306 may be representative of a well in well group 204.

Well 312, as shown in FIG. 3*a*, injecting into formation 306 may be representative of a well in well group 204, and well 312 as shown in FIG. 3*b* producing from formation 306 may be representative of a well in well group 202.

In order to recover miscible enhanced oil recovery agent from formation 306 back to well 312, a remediation agent may be injected into another adjacent well (not shown), after the oil recovery from formation 306 has been completed. Suitable remediation agents are discussed below.

FIG. 3*c:*

Figure 3C:
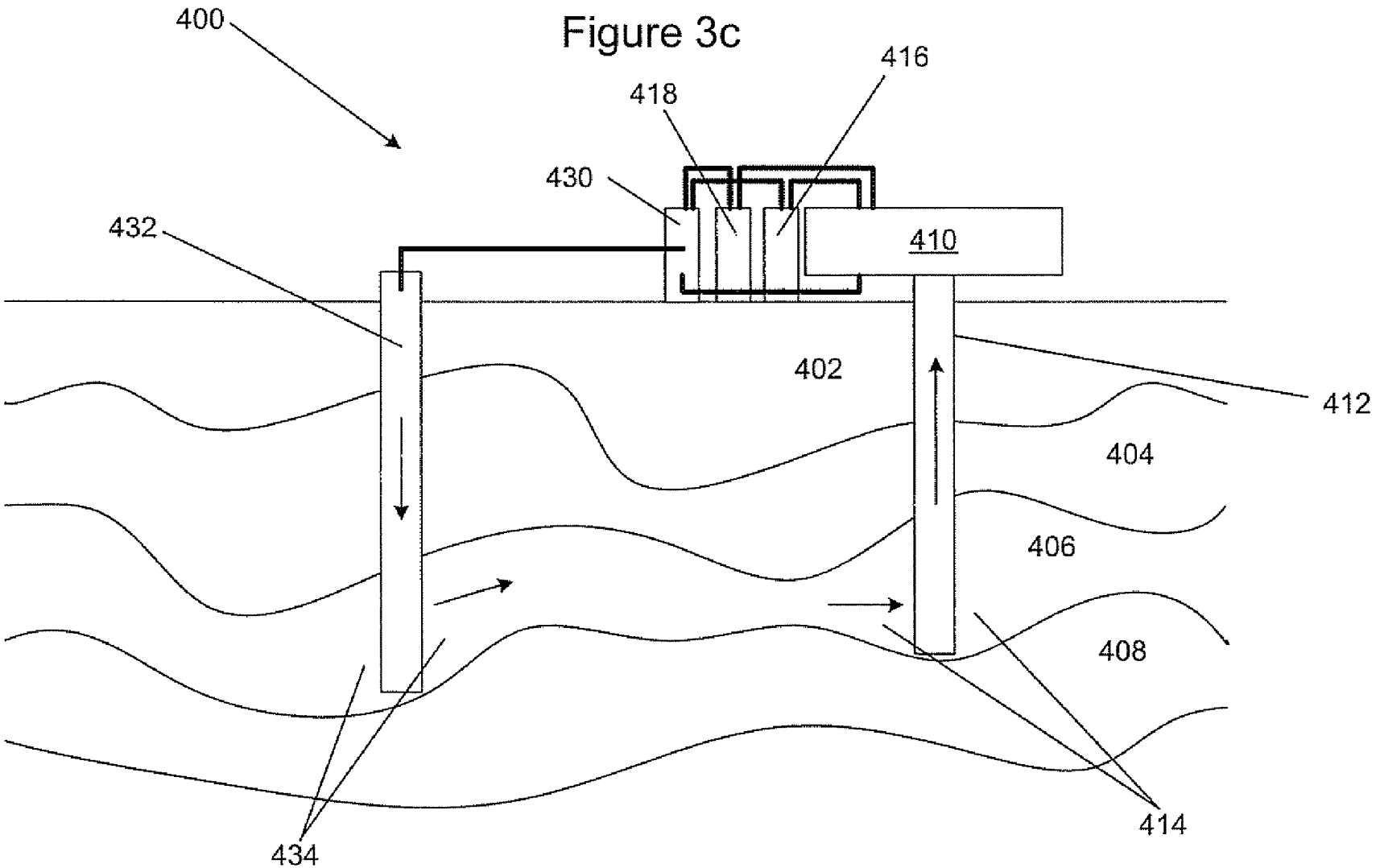

Referring now to FIG. 3*c*, in some embodiments of the invention, system 400 is illustrated. System 400 includes underground formation 402, formation 404, formation 406, and formation 408. Production facility 410 may be provided at the surface. Well 412 traverses formation 402 and 404 has openings at formation 406. Portions of formation 414 may be optionally fractured and/or perforated. As oil and gas is produced from formation 406 it enters portions 414, and travels up well 412 to production facility 410. Gas and liquid may be separated, and gas may be sent to gas storage 416, and liquid may be sent to liquid storage 418. Production facility 410 may be able to produce and/or store miscible enhanced oil recovery formulation, which may be produced and stored in production/storage 430. Hydrogen sulfide and/or other sulfur containing compounds from well 412 may be sent to miscible enhanced oil recovery formulation production/storage 430. Miscible enhanced oil recovery formulation may be pumped down well 432, to portions 434 of formation 406. Miscible enhanced oil recovery formulation traverses formation 406 to aid in the production of oil and gas, and then the miscible enhanced oil recovery formulation, oil and/or gas may all be produced to well 412, to production facility 410. Miscible enhanced oil recovery formulation may then be recycled, for example by boiling the formulation, condensing it or filtering or reacting it, then re-injecting the formulation into well 432.

In some embodiments, a quantity of miscible enhanced oil recovery formulation or miscible enhanced oil recovery formulation mixed with other components may be injected into well 432, followed by another component to force miscible enhanced oil recovery formulation or miscible enhanced oil recovery formulation mixed with other components across formation 406, for example air; water in gas or liquid form; water mixed with one or more salts, polymers, and/or surfactants; carbon dioxide; other gases; other liquids; and/or mixtures thereof.

In some embodiments, well 412 which is producing oil and/or gas may be representative of a well in well group 202, and well 432 which is being used to inject miscible enhanced oil recovery formulation may be representative of a well in well group 204.

In some embodiments, well 412 which is producing oil and/or gas may be representative of a well in well group 204, and well 432 which is being used to inject miscible enhanced oil recovery formulation may be representative of a well in well group 202.

In order to recover miscible enhanced oil recovery agent from formation 406 back to well 432, a remediation agent may be injected into well 412, after the oil recovery from formation 406 and well 412 has been completed. Suitable remediation agents are discussed below.

Remediation Agents:

Suitable remediation agents include water in liquid or vapor form, foams, aqueous surfactant solutions, aqueous polymer solutions, carbon dioxide, natural gas, and/or other hydrocarbons, and mixtures thereof.

In one embodiment, suitable remediation agents include aqueous surfactant solutions. Suitable aqueous surfactant solutions are disclosed in U.S. Pat. No. 3,943,160; U.S. Pat. No. 3,946,812; U.S. Pat. No. 4,077,471; U.S. Pat. No. 4,216,079; U.S. Pat. No. 5,318,709; U.S. Pat. No. 5,723,423; U.S. Pat. No. 6,022,834; U.S. Pat. No. 6,269,881; and by Wellington, et al. in "Low Surfactant Concentration Enhanced Waterflooding," Society of Petroleum Engineers, 1995; all of which are incorporated by reference herein.

Mobilization of residual miscible enhanced oil recovery agents retained in a formation may be difficult due to viscosity of the miscible enhanced oil recovery agents and capillary effects of fluids in pores of the formation. As used herein "capillary forces" refers to attractive forces between fluids and at least a portion of the formation. In an embodiment, capillary forces may be overcome by increasing the pressures within a formation. In other embodiments, capillary forces may be overcome by reducing the interfacial tension between fluids in a formation. The ability to reduce the capillary forces in a formation may depend on a number of factors, including, but not limited to, the temperature of the formation, the salinity of water in the formation, and the composition of the miscible enhanced oil recovery agents in the formation.

Methods to recover residual miscible enhanced oil recovery agents retained in a formation may include adding sources of water (e.g., brine, steam), gases, polymers, monomers or any combinations thereof to the formation to increase mobilization of miscible enhanced oil recovery agents.

In one embodiment, a formation may be treated with a flood of water. A waterflood may include injecting water into a portion of a formation through injection wells. Flooding of at least a portion of the formation may water wet a portion of the formation. The water wet portion of the formation may be pressurized by known methods and a water/miscible enhanced oil recovery agent mixture may be collected using one or more production wells. The water layer, however, may not mix with the miscible enhanced oil recovery agent layer efficiently. Poor mixing efficiency may be due to a high interfacial tension between the water and miscible enhanced oil recovery agents.

Production from a formation may be enhanced by treating the formation with a polymer and/or monomer that may mobilize miscible enhanced oil recovery agents to one or more production wells. The polymer and/or monomer may reduce the mobility of the water phase in pores of the formation. The reduction of water mobility may allow the miscible enhanced oil recovery agents to be more easily mobilized through the formation. Polymers may include, but are not limited to, polyacrylamides, partially hydrolyzed polyacrylamide, polyacrylates, ethylenic copolymers, biopolymers, carboxymethylcellulose, polyvinyl alcohol, polystyrene sulfonates, polyvinylpyrrolidone, AMPS (2-acrylamide-2-methyl propane sulfonate) or combinations thereof. Examples of ethylenic copolymers include copolymers of acrylic acid and acrylamide, acrylic acid and lauryl acrylate, lauryl acrylate and acrylamide. Examples of biopolymers include xanthan gum and guar gum. In some embodiments, polymers may be crosslinked in situ in a formation. In other embodiments, polymers may be generated in situ in a formation. Polymers and polymer preparations for use in recovery are described in U.S. Pat. No. 6,427,268; U.S. Pat. No. 6,439,308; U.S. Pat. No. 5,654,261, U.S. Pat. No. 5,284,206; U.S. Pat. No. 5,199,490, and U.S. Pat. No. 5,103,909, all of which are incorporated by reference herein.

In an embodiment, a remediation agent may be provided to the formation. In an embodiment, a remediation composition may include one or more nonionic additives (e.g., alcohols, ethoxylated alcohols, nonionic surfactants and/or sugar based esters) and one or more anionic surfactants (e.g. sulfates, sulfonates, ethoxylated sulfates, and/or phosphates).

In an embodiment, an aliphatic nonionic additive may be used in a remediation agent. As used herein, the term "aliphatic" refers to a straight or branched chain of carbon and hydrogen atoms. In some embodiments, an aliphatic portion of an aliphatic nonionic additive may have an average carbon number from 10 to 24. In some embodiments, an aliphatic portion of an aliphatic nonionic additive may have an average carbon number from 12 to 18. In some embodiments, the aliphatic nonionic additive may include a branched aliphatic portion. A branched aliphatic portion of an aliphatic nonionic additive may have an average carbon number from 16 to 17. In some embodiments, a branched aliphatic group of an aliphatic nonionic additive may have less than about 0.5 percent aliphatic quaternary carbon atoms. In an embodiment, an average number of branches per aliphatic nonionic additive ranges from about 0.1 to about 2.5. In other embodiments, an average number of branches per aliphatic nonionic additive ranges from about 0.7 to about 2.5.

In an embodiment, an aliphatic nonionic additive may be a long chain aliphatic alcohol. The term "long chain," as used herein, refers to a carbon chain having an average carbon number from 10 to 30. A long chain aliphatic alcohol (e.g., a long chain primary alcohol) may be purchased commercially (e.g., Neodol® alcohols manufactured by Shell Chemical Co., Houston, Tex.). In certain embodiments, a long chain aliphatic alcohol may be prepared by a variety of generally known methods. A long chain aliphatic alcohol may have an average carbon number from 10 to 24. In some embodiments, a long chain aliphatic alcohol may have an average carbon number from 12 to 18. In other embodiments, a long chain aliphatic alcohol may have an average carbon number from 16 to 17. In an embodiment, a portion of the long chain aliphatic alcohol may be branched. Branched long chain aliphatic alcohols may be prepared by hydroformylation of a branched olefin.

In an embodiment, an aliphatic anionic surfactant may be used in a remediation agent. In certain embodiments, an aliphatic portion of an aliphatic anionic surfactant may have an average carbon number from 10 to 24. In some embodiments, an aliphatic portion of an aliphatic anionic surfactant may have an average carbon number from 12 to 18. In other embodiments, an aliphatic portion of an aliphatic anionic surfactant may have an average carbon number from 16 to 17

A remediation agent may be prepared by combining (e.g., mixing) a nonionic additive (e.g., an aliphatic nonionic additive) with an appropriate amount of an anionic surfactant (e.g., an aliphatic anionic surfactant). In one embodiment, a remediation agent may include an aliphatic anionic surfactant and an aliphatic nonionic additive. In some embodiments, an amount of an aliphatic anionic surfactant in a composition may be greater than about 40 wt. % of the total composition. In an embodiment, an amount of an aliphatic anionic surfactant in a remediation agent main range from about 60 wt. % to about 90 wt. % of the total composition. An amount of an aliphatic anionic surfactant in a composition may range from about 80 wt. % to about 90 wt. % of the total weight of the composition. An amount of an aliphatic nonionic additive in a composition may be less than about 60 wt. % of the total weight of the composition. The composition may include an amount of an aliphatic nonionic additive from about 10 wt. % to about 40 wt. % of the total weight of the composition. In some embodiments, an amount of an aliphatic nonionic additive may range from about 10 wt. % to about 20 wt. % of the total weight of the composition. The remainder of the composition may include, but is not limited to, water, low molecular weight alcohols, organic solvents, alkyl sulfonates, aryl sulfonates, brine or combinations thereof. Low molecular weight alcohols includes but are not limited to, methanol, ethanol, propanol, isopropyl alcohol, tert-butyl alcohol, sec-butyl alcohol, butyl alcohol, tert-amyl alcohol or combinations thereof. Organic solvents include, but are not limited to, methyl ethyl ketone, acetone, lower alkyl cellosolves, lower alkyl carbitols or combinations thereof.

The aliphatic portion of an aliphatic nonionic additive and an aliphatic nonionic additive used in a remediation agent may have the same average carbon number, branching and/or number of quaternary carbons. Alternatively, an aliphatic nonionic additive may vary in carbon number, branching, or number of quaternary carbon atoms from an anionic surfactant used in a remediation agent. In an embodiment, an aliphatic anionic surfactant and an aliphatic nonionic additive may both have an average carbon number from 16 to 17. Both the aliphatic anionic surfactant and aliphatic nonionic additive may have branched aliphatic groups, in some embodiments. In other embodiments, an aliphatic anionic surfactant with an average carbon number of 16 to 17 may be combined with an aliphatic nonionic additive having an average carbon number from 10 to 24. The aliphatic nonionic additive and the aliphatic anionic surfactant may both have a branched aliphatic group, in certain embodiments. A branched aliphatic nonionic additive may, in other embodiments, include branches that are primarily ethyl and methyl groups. In certain embodiments, branches on the branched aliphatic anionic surfactant may be methyl groups.

In an embodiment, a composition may include an aliphatic anionic surfactant in combination with one or more sugar based surfactants. Sugar based surfactants include surfactants composed of a long chain aliphatic ester. In one embodiment, a sugar based surfactant is composed of a long chain aliphatic portion coupled to the carbonyl group of the ester and a sugar coupled to the oxygen portion of the ester. Sugar based surfactants include, but are not limited to, sorbitan monolaurate, sorbitan monplamitate, sorbitan monostearate, sorbitan monooleate, sorbitan sesquioleate, sorbitan trioleate, polyoxyethylene (20) sorbitan monolaurate, polyoxyethylene (20) sorbitan monopalmitate, polyoxyethylene (20) sorbitan monostearate, polyoxyethylene (20) sorbitan monooleate, polyoxyethylene (20) sorbitan trioleate or combinations thereof. Other sugar based surfactants include sugar based ethers and sugar based ethoxylated ethers.

In some embodiments, an amount of an aliphatic anionic surfactant in a composition may be greater than about 40 wt. % of the total composition. The composition may include an aliphatic anionic surfactant in an amount from about 50 wt. % to about 90 wt. % of the total composition. An amount of an aliphatic, anionic surfactant in a composition may range from about 80 wt. % to about 90 wt. % of the total weight of the composition. An amount of a sugar based surfactant in a composition may be less than about 60 wt. % of the total weight of the composition. The composition may include an amount of a sugar based surfactant from about 10 wt. % to about 50 wt. % of the total weight of the composition. In some embodiments, an amount of a sugar based surfactant may range from about 10 wt % to about 20 wt. % of the total weight of the composition. The remainder of the composition may include, but is not limited to, water, low molecular weight alcohols, organic solvents, alkyl sulfonates, aryl sulfonates, brine or combinations thereof. Low molecular weight alcohols include, but are not limited to, methanol, ethanol, propanol, isopropyl alcohol, tert-butyl alcohol, sec-butyl alcohol, butyl alcohol, tert-amyl alcohol or combinations thereof. Organic solvents include, but are not limited to, methyl ethyl ketone, acetone, lower alkyl cellosolves, lower alkyl carbitols or combinations thereof.

In an embodiment, a composition may include an aliphatic nonionic additive, an aliphatic anionic surfactant and one or more sugar based surfactants. In certain embodiments, a portion of the aliphatic group of the aliphatic nonionic additive may be branched. In other embodiments, a portion of the aliphatic anionic surfactant may be branched.

A remediation agent may interact with miscible enhanced oil recovery agents in at least a portion of the formation. Interaction with the miscible enhanced oil recovery agents may reduce an interfacial tension of the miscible enhanced oil recovery agents with one or more fluids in the formation. In other embodiments, a remediation agent may reduce the interfacial tension between the miscible enhanced oil recovery agents and an overburden/underburden of a formation. Reduction of the interfacial tension may allow at least a portion of the miscible enhanced oil recovery agents to mobilize through the formation.

A remediation agent may be provided to the formation in an amount based on miscible enhanced oil recovery agents present in a formation. The amount of remediation agent, however, may be too small to be accurately delivered to the formation using known delivery techniques (e.g., pumps). To facilitate delivery of small amounts of the remediation agent to the formation, the remediation agent may be combined with water and/or brine to produce an injectable fluid. An amount of a remediation agent injected into formation 100 may be less than 0.5 wt. % of the total weight of the injectable fluid. In certain embodiments, an amount of a remediation agent provided to a formation may be less than 0.3 wt. % of the total weight of injectable fluid. In some embodiments, an amount of a remediation agent provided to a formation may be less than 0.1 wt. % of the total weight of injectable fluid. In other embodiments, an amount of a remediation agent provided to a formation may be less than 0.05 wt. % of the total weight of injectable fluid.

The remediation agent may interact with at least a portion of the miscible enhanced oil recovery agents in the formation. The interaction of the remediation agent with miscible enhanced oil recovery agent may reduce at least a portion of the interfacial tension between the miscible enhanced oil recovery agents and formation. At least a portion of the remediation agent/miscible enhanced oil recovery agent/fluids mixture may be mobilized to a production well. Products obtained from the production well 150 may include, but are not limited to, components of the remediation agent (e.g., a long chain aliphatic alcohol and/or a long chain aliphatic acid salt), methane, carbon monoxide, water, miscible enhanced oil recovery agents, ammonia, asphaltenes, or combinations thereof. Miscible enhanced oil recovery agent production from formation 100 may be increased by greater than about 50% after the remediation agent has been added to a formation.

Interaction of the remediation agent with at least a portion of miscible enhanced oil recovery agents in the formation may reduce at least a portion of an interfacial tension between the miscible enhanced oil recovery agents and the formation. Reduction of at least a portion of the interfacial tension may mobilize at least a portion of miscible enhanced oil recovery agents through formation. Mobilization of at least a portion of miscible enhanced oil recovery agents, however, may not be at an economically viable rate. In one embodiment, polymers may be injected into formation through an injection well, after treatment of the formation with a remediation agent, to increase mobilization of at least a portion of the miscible enhanced oil recovery agents through the formation. Suitable polymers include, but are not limited to, CIBA® ALCOFLOOD®, manufactured by Ciba Specialty Additives (Tarrytown, N.Y.), Tramfloc® manufactured by Tramfloc Inc. (Temple, Ariz.), and HE® polymers manufactured by Chevron Phillips Chemical Co. (The Woodlands, Tex.). Interaction between the miscible enhanced oil recovery agents, the remediation agent and the polymer may increase mobilization of at least a portion of the miscible enhanced oil recovery agents remaining in the formation to production well.

In some embodiments, a remediation agent may include an inorganic salt (e.g. sodium carbonate (Na[2]CO[3]), sodium chloride NaCl), or calcium chloride (CaCl[2])). The addition of the inorganic salt may help the remediation agent disperse throughout a miscible enhanced oil recovery agent/water mixture. The enhanced dispersion of the remediation agent may decrease the interactions between the miscible enhanced oil recovery agent and water interface. The decreased interaction may lower the interfacial tension of the mixture and provide a fluid that is more mobile.

ALTERNATIVE EMBODIMENTS

In some embodiments, oil and/or gas may be recovered from a formation into a well, and flow through the well and flowline to a facility. In some embodiments, enhanced oil recovery, with the use of an agent for example steam, water, a surfactant, a polymer flood, and/or a miscible agent such as a carbon disulfide formulation or carbon dioxide, may be used to increase the flow of oil and/or gas from the formation.

In some embodiments, oil and/or gas recovered from a formation may include a sulfur compound. The sulfur compound may include hydrogen sulfide, mercaptans, sulfides and disulfides other than hydrogen disulfide, or heterocyclic sulfur compounds for example thiophenes, benzothiophenes, or substituted and condensed ring dibenzothiophenes, or mixtures thereof.

In some embodiments, a sulfur compound from the formation may be converted into a carbon disulfide formulation. The conversion of at least a portion of the sulfur compound into a carbon disulfide formulation may be accomplished by any known method. Suitable methods may include oxidation reaction of the sulfur compound to sulfur and/or sulfur dioxides, and by reaction of sulfur and/or sulfur dioxide with carbon and/or a carbon containing compound to form the carbon disulfide formulation. The selection of the method used to convert at least a portion of the sulfur compound into a carbon disulfide formulation is not critical.

In some embodiments, a suitable miscible enhanced oil recovery agent may be a carbon disulfide formulation. The carbon disulfide formulation may include carbon disulfide and/or carbon disulfide derivatives for example, thiocarbonates, xanthates and mixtures thereof; and optionally one or more of the following: hydrogen sulfide, sulfur, carbon dioxide, hydrocarbons, and mixtures thereof.

In some embodiments, a suitable method of producing a carbon disulfide formulation is disclosed in copending U.S. patent application Ser. No. 11/409,436, filed on Apr. 19, 2006. U.S. patent application Ser. No. 11/409,436 is herein incorporated by reference in its entirety.

In some embodiments, suitable miscible enhanced oil recovery agents include carbon disulfide, hydrogen sulfide, carbon dioxide, octane, pentane, LPG, C2-C6 aliphatic hydrocarbons, nitrogen, diesel, mineral spirits, naptha solvent, asphalt solvent, kerosene, acetone, xylene, trichloroethane, or mixtures of two or more of the preceding, or other miscible enhanced oil recovery agents as are known in the art. In some embodiments, suitable miscible enhanced oil recovery agents are first contact miscible or multiple contact miscible with oil in the formation.

In some embodiments, suitable immiscible enhanced oil recovery agents include water in gas or liquid form, air, mixtures of two or more of the preceding, or other immiscible enhanced oil recovery agents as are known in the art. In some embodiments, suitable immiscible enhanced oil recovery agents are not first contact miscible or multiple contact miscible with oil in the formation.

In some embodiments, immiscible and/or miscible enhanced oil recovery agents injected into the formation may be recovered from the produced oil and/or gas and re-injected into the formation.

In some embodiments, oil as present in the formation prior to the injection of any enhanced oil recovery agents has a viscosity of at least about 100 centipoise, or at least about 500 centipoise, or at least about 1000 centipoise, or at least about 2000 centipoise, or at least about 5000 centipoise, or at least about 10,000 centipoise. In some embodiments, oil as present in the formation prior to the injection of any enhanced oil recovery agents has a viscosity of up to about 5,000,000 centipoise, or up to about 2,000,000 centipoise, or up to about 1,000,000 centipoise, or up to about 500,000 centipoise.

Releasing at least a portion of the miscible enhanced oil recovery agent and/or other liquids and/or gases may be accomplished by any known method. One suitable method is injecting the miscible enhanced oil recovery formulation into a single conduit in a single well, allowing carbon disulfide formulation to soak, and then pumping out at least a portion of the carbon disulfide formulation with gas and/or liquids. Another suitable method is injecting the miscible enhanced oil recovery formulation into a first well, and pumping out at least a portion of the miscible enhanced oil recovery formulation with gas and/or liquids through a second well. The selection of the method used to inject at least a portion of the miscible enhanced oil recovery formulation and/or other liquids and/or gases is not critical.

In some embodiments, the miscible enhanced oil recovery formulation and/or other liquids and/or gases may be pumped into a formation at a pressure up to the fracture pressure of the formation.

In some embodiments, the miscible enhanced oil recovery formulation may be mixed in with oil and/or gas in a formation to form a mixture which may be recovered from a well. In some embodiments, a quantity of the miscible enhanced oil recovery formulation may be injected into a well, followed by another component to force carbon the formulation across the formation. For example air, water in liquid or vapor form, carbon dioxide, other gases, other liquids, and/or mixtures thereof may be used to force the miscible enhanced oil recovery formulation across the formation.

In some embodiments, the miscible enhanced oil recovery formulation may be heated prior to being injected into the formation to lower the viscosity of fluids in the formation, for example heavy oils, paraffins, asphaltenes, etc.

In some embodiments, the miscible enhanced oil recovery formulation may be heated and/or boiled while within the formation, with the use of a heated fluid or a heater, to lower the viscosity of fluids in the formation. In some embodiments, heated water and/or steam may be used to heat and/or vaporize the miscible enhanced oil recovery formulation in the formation.

In some embodiments, the miscible enhanced oil recovery formulation may be heated and/or boiled while within the formation, with the use of a heater. One suitable heater is disclosed in copending U.S. patent application Ser. No. 10/693,816, filed on Oct. 24, 2003. U.S. patent application Ser. No. 10/693,816 is herein incorporated by reference in its entirety.

In some embodiments, oil and/or gas produced may be transported to a refinery and/or a treatment facility. The oil and/or gas may be processed to produced to produce commercial products such as transportation fuels such as gasoline and diesel, heating fuel, lubricants, chemicals, and/or polymers. Processing may include distilling and/or fractionally distilling the oil and/or gas to produce one or more distillate fractions. In some embodiments, the oil and/or gas, and/or the one or more distillate fractions may be subjected to a process of one or more of the following: catalytic cracking, hydrocracking, hydrotreating, coking, thermal cracking, distilling, reforming, polymerization, isomerization, alkylation, blending, and dewaxing.

ILLUSTRATIVE EMBODIMENTS

In one embodiment of the invention, there is disclosed a system for producing oil and/or gas from an underground formation comprising a first array of wells dispersed above the formation; a second array of wells dispersed above the formation; wherein the first array of wells comprises a mechanism to inject a miscible enhanced oil recovery formulation into the formation while the second array of wells comprises a mechanism to produce oil and/or gas from the formation for a first time period; and wherein the second array of wells comprises a mechanism to inject a remediation agent into the formation while the first array of wells comprises a mechanism to produce the miscible enhanced oil recovery formulation from the formation for a second time period. In some embodiments, a well in the first array of wells is at a distance of 10 meters to 1 kilometer from one or more adjacent wells in the second array of wells. In some embodiments, the underground formation is beneath a body of water. In some embodiments, the system also includes a mechanism for injecting an immiscible enhanced oil recovery formulation into the formation, after the miscible enhanced oil recovery formulation has been released into the formation. In some embodiments, the system also includes a miscible enhanced oil recovery formulation selected from the group consisting of a carbon disulfide formulation, hydrogen sulfide, carbon dioxide, octane, pentane, LPG, C2-C6 aliphatic hydrocarbons, nitrogen, diesel, mineral spirits, naptha solvent, asphalt solvent, kerosene, acetone, xylene, trichloroethane, and mixtures thereof. In some embodiments, the system also includes an immiscible enhanced oil recovery formulation selected from the group consisting of water in gas or liquid form, air, and mixtures thereof. In some embodiments, the first array of wells comprises from 5 to 500 wells, and the second array of wells comprises from 5 to 500 wells. In some embodiments, the system also includes a miscible enhanced oil recovery formulation comprising a carbon disulfide formulation. In some embodiments, the system also includes a mechanism for producing a carbon disulfide formulation. In some embodiments, the underground formation comprises an oil having a viscosity from 100 to 5,000,000 centipoise. In some embodiments, the first array of wells comprises a miscible enhanced oil recovery formulation profile in the formation, and the second array of wells comprises an oil recovery profile in the formation, the system further comprising an overlap between the miscible enhanced oil recovery formulation profile and the oil recovery profile.

In one embodiment of the invention, there is disclosed a method for producing oil and/or gas comprising injecting a carbon disulfide formulation into a formation for a first time period from a first well; producing oil and/or gas from the formation from a second well for the first time period; injecting a remediation agent into the formation for a second time period from the second well; and producing the carbon disulfide formulation from the formation from the first well for the second time period. In some embodiments, the method also includes recovering carbon disulfide formulation from the oil and/or gas, if present, and then injecting at least a portion of the recovered carbon disulfide formulation into the formation. In some embodiments, injecting the carbon disulfide formulation comprises injecting at least a portion of the carbon disulfide formulation into the formation in a mixture with one or more of hydrocarbons; sulfur compounds other than carbon disulfide; carbon dioxide; carbon monoxide; or mixtures thereof. In some embodiments, the method also includes heating the carbon disulfide formulation prior to injecting the carbon disulfide formulation into the formation, or while within the formation. In some embodiments, the carbon disulfide formulation is injected at a pressure from 0 to 37,000 kilopascals above the initial reservoir pressure, measured prior to when carbon disulfide injection begins. In some embodiments, the underground formation comprises a permeability from 0.0001 to 15 Darcies, for example a permeability from 0.001 to 1 Darcy. In some embodiments, any oil, as present in the underground formation prior to the injecting the carbon disulfide formulation, has a sulfur content from 0.5% to 5%, for example from 1% to 3%. In some embodiments, the method also includes converting at least a portion of the recovered oil and/or gas into a material selected from the group consisting of transportation fuels such as gasoline and diesel, heating fuel, lubricants, chemicals, and/or polymers. In some embodiments, the remediation agent comprises water and a surfactant. In some embodiments, the remediation agent comprises water and a polymer dissolved in the water. In some embodiments, the method also includes injecting water into the formation for a third time period from the first well; and producing the remediation agent from the formation from the second well for the third time period.

In one embodiment of the invention, there is disclosed a method for producing oil and/or gas comprising injecting a miscible enhanced oil recovery formulation into a formation for a first time period from a first well; producing oil and/or gas from the formation from a second well for the first time period; injecting a remediation agent into the formation for a second time period from the second well; and producing the miscible enhanced oil recovery formulation from the formation from the first well for the second time period. In some embodiments, the first and second time period comprise a cycle, the cycle from 12 hours to 1 year. In some embodiments, the method also includes injecting an immiscible enhanced oil recovery formulation into the formation for a time period after the first time period and prior to the second time period from the first well, to push the miscible enhanced oil recovery formulation through the formation. In some embodiments, the method also includes injecting water into the formation for a time period after the second time period from the second well, to push the remediation agent through the formation. In some embodiments, the produced oil and/or gas comprises a sulfur compound, further comprising converting at least a portion of the sulfur compound into a miscible enhanced oil recovery formulation. In some embodiments, the miscible enhanced oil recovery formulation comprises a carbon disulfide formulation. In some embodiments, the method also includes heating the miscible enhanced oil recovery formulation. In some embodiments, the remediation agent comprises water and a surfactant.

Those of skill in the art will appreciate that many modifications and variations are possible in terms of the disclosed embodiments of the invention, configurations, materials and methods without departing from their spirit and scope. Accordingly, the scope of the claims appended hereafter and their functional equivalents should not be limited by particular embodiments described and illustrated herein, as these are merely exemplary in nature.

The invention claimed is:

1. A system for producing oil and/or gas from an underground formation comprising:

a first array of wells dispersed above the formation;

a second array of wells dispersed above the formation;

wherein the first array of wells comprises a mechanism to inject a miscible enhanced oil recovery formulation into the formation while the second array of wells comprises a mechanism to produce oil and/or gas from the formation for a first time period; and wherein the second array of wells comprises a mechanism to inject a remediation agent into the formation while the first array of wells comprises a mechanism to produce the miscible enhanced oil recovery formulation from the formation for a second time period;

wherein the miscible enhanced oil recovery formulation comprises a carbon disulfide formulation.

2. The system of claim 1, wherein a well in the first array of wells is at a distance of 10 meters to 1 kilometer from one or more adjacent wells in the second array of wells.

3. The system of claim 1, wherein the underground formation is beneath a body of water.

4. The system of claim 1, further comprising a mechanism for injecting an immiscible enhanced oil recovery formulation into the formation, after the miscible enhanced oil recovery formulation has been released into the formation.

5. The system of claim 1, further comprising a miscible enhanced oil recovery formulation selected from the group consisting of a carbon disulfide formulation, hydrogen sulfide, carbon dioxide, octane, pentane, LPG, C2-C6 aliphatic hydrocarbons, diesel, mineral spirits, naptha solvent, asphalt solvent, kerosene, acetone, xylene, trichloroethane, and mixtures thereof.

6. The system of claim 1, wherein the first array of wells comprises from 5 to 500 wells, and the second array of wells comprises from 5 to 500 wells.

7. The system of claim 1, further comprising a mechanism for producing a carbon disulfide formulation.

8. The system of claim 1, wherein the underground formation comprises an oil having a viscosity from 100 to 5,000,000 centipoise.

9. The system of claim 1, wherein the first array of wells comprises a miscible enhanced oil recovery formulation profile in the formation, and the second array of wells comprises an oil recovery profile in the formation, the system further comprising an overlap between the miscible enhanced oil recovery formulation profile and the oil recovery profile.

10. A method for producing oil and/or gas comprising:

injecting a carbon disulfide formulation into a formation for a first time period from a first well;

producing oil and/or gas from the formation from a second well for the first time period;

injecting a remediation agent into the formation for a second time period from the second well; and producing the carbon disulfide formulation from the formation from the first well for the second time period.

11. The method of claim 10, further comprising recovering carbon disulfide formulation from the oil and/or gas, if present, and then injecting at least a portion of the recovered carbon disulfide formulation into the formation.

12. The method of claim 10, wherein injecting the carbon disulfide formulation comprises injecting at least a portion of the carbon disulfide formulation into the formation in a mixture with one or more of hydrocarbons; sulfur compounds other than carbon disulfide; carbon dioxide; carbon monoxide; or mixtures thereof.

13. The methods of claim 10, further comprising heating the carbon disulfide formulation prior to injecting the carbon disulfide formulation into the formation, or while within the formation.

14. The method of claim 10, wherein the carbon disulfide formulation is injected at a pressure from 0 to 37,000 kilopascals above the initial reservoir pressure, measured prior to when carbon disulfide injection begins.

15. The method of claim 10, wherein the underground formation comprises a permeability from 0.0001 to 15 Darcies.

16. The method of claim 10, wherein any oil, as present in the underground formation prior to the injecting the carbon disulfide formulation, has a sulfur content from 0.5% to 5%.

17. The method of claim 10, further comprising converting at least a portion of the recovered oil and/or gas into a material selected from the group consisting of transportation fuels such as gasoline and diesel, heating fuel, lubricants, chemicals, and/or polymers.

18. The method of claim 10, wherein the remediation agent comprises water and a surfactant.

19. The method of claim 10, wherein the remediation agent comprises water and a polymer dissolved in the water.

20. The method of claim 10, further comprising:

injecting water into the formation for a third time period from the first well; and producing the remediation agent from the formation from the second well for the third time period.

21. A method for producing oil and/or gas comprising:

injecting a miscible enhanced oil recovery formulation into a formation for a first time period from a first well, wherein the miscible enhanced oil recovery formulation comprises a carbon disulfide formulation;

producing oil and/or gas from the formation from a second well for the first time period;

injecting a remediation agent into the formation for a second time period from the second well; and producing the miscible enhanced oil recovery formulation from the formation from the first well for the second time period.

22. The method of claim 21, wherein the first and second time period comprise a cycle, the cycle from 12 hours to 1 year.

23. The method of claim 21, further comprising:

injecting an immiscible enhanced oil recovery formulation into the formation for a time period after the first time period and prior to the second time period from the first well, to push the miscible enhanced oil recovery formulation through the formation.

24. The method of claim 21, further comprising:

injecting water into the formation for a time period after the second time period from the second well, to push the remediation agent through the formation.

25. The method of claim 21, wherein the produced oil and/or gas comprises a sulfur compound, further comprising converting at least a portion of the sulfur compound into a miscible enhanced oil recovery formulation.

26. The method of claim 21, further comprising heating the miscible enhanced oil recovery formulation.

27. The method of claim 21, wherein the remediation agent comprises water and a surfactant.

* * * * *